US005378564A

United States Patent [19]

Nakayama et al.

[11] Patent Number: 5,378,564

[45] Date of Patent: Jan. 3, 1995

[54] ELECTROPHOTOGRAPHIC LITHOGRAPHIC PRINTING PLATE PRECURSOR

[75] Inventors: Takao Nakayama; Shigeyuki Dan; Hidefumi Sera, all of Shizuoka, Japan

[73] Assignee: Fuji Photo Film Co., Ltd., Kanagawa, Japan

[21] Appl. No.: 21,682

[22] Filed: Feb. 24, 1993

[30] Foreign Application Priority Data

Feb. 24, 1992 [JP] Japan ..... 4-036460
Feb. 24, 1992 [JP] Japan ..... 4-036461

[51] Int. Cl.[6] ..... G03G 5/14

[52] U.S. Cl. ..... 430/49; 430/56; 430/60; 430/103

[58] Field of Search ..... 430/49, 56, 60, 302, 430/103

[56] References Cited

U.S. PATENT DOCUMENTS 4,719,162 1/1988 Nakano et al. ..... 430/49
5,057,389 10/1991 Nakayama et al. ..... 430/49

*Primary Examiner*—Steve Rosasco
*Attorney, Agent, or Firm*—Sughrue, Mion, Zinn, Macpeak & Seas

[57] ABSTRACT

An electrophotographic lithographic printing plate precursor capable of well maintaining both the electrophotographic properties and the printing properties is provided, which comprises, at least, a photoconductive layer on one side of a support and an under layer directly under the photoconductive layer, in which the under layer consists of a plurality of layers comprising an outermost layer having a surface resistivity of at most $1\times10^{11}$ Ω and an inner layer having a Cobb's water absorbing capacity of at most 15 g/m$^2$ (45 minute value) or having a Young's Modulus of at most 1000 kg/cm$^2$.

15 Claims, No Drawings

ELECTROPHOTOGRAPHIC LITHOGRAPHIC PRINTING PLATE PRECURSOR

BACKGROUND OF THE INVENTION

1. Field of the Invention

This invention relates to an electrophotographic lithographic printing plate precursor and more particularly, it is concerned with an electrophotographic lithographic printing plate precursor excellent in printing adaptability as well as printing efficiency and capable of giving a high image quality print.

2. Description of the Prior Art

Up to the present time, there has generally been employed an electrophotographic process for the production of a lithographic printing plate precursor comprising subjecting the photoconductive layer of an electrophotographic lithographic printing plate precursor to uniform static charge, to imagewise exposure and then to dry development with a dry toner or to liquid development with a liquid toner to obtain a toner image, then fixing this toner image and processing with an oil-desensitizing solution (etching solution) to render hydrophilic a non-image area free from the toner image. The made-up printing plate is fitted to a printing drum and then subjected to printing, during which dampening water is used. As a base for an electrophotographic lithographic printing plate precursor, a paper which has previously been rendered electroconductive, etc. is used, but this paper base is penetrated with the above described etching solution or dampening water during printing, resulting in bad influences on the printing durability, image quality or performances. That is, when the above described etching solution or dampening water during printing penetrates such a base, there arises a problem such as expansion or cutting of a printing plate.

For the electrophotographic lithographic printing plate precursor, therefore, it is required to have the properties as the general electrophotographic light-sensitive material, that is, uniform surface electric property and excellent image forming capacity and developing property as well as environmental stability such as less fogging or less printing unevenness, and moreover, to have the printing properties when used as a printing plate, that is, the water resistance in an oil-desensitizing treatment or to dampening water, organic solvent resistance printing workability and environmental stability.

To this end, it has been proposed to coat the one or both surfaces of a support with, for example, an epoxy resin or ethylene-acrylic acid copolymer having water resisting property (Japanese Patent Laid-Open Publication Nos. 138904/1975, 105580/1980 and 68758/1984) or to provide with a laminated layer of polyethylene or the like (Japanese Patent Laid-Open Publication Nos. 57994/ 1983).

Furthermore, there have been proposed a method comprising providing an opposite surface to a surface of a support having a photoconductive layer (also called "top layer") with a back coating layer (back layer) so as to impart water resistance or to maintain various functions and a method comprising providing an intermediate layer between a photoconductive layer and a precoating layer so as to well maintain both the electrophotographic properties and water resistance (Japanese Patent Laid-Open Publication No. 50465/1990).

When an under layer (undercoated layer) is provided just under a photoconductive layer, however, it is more difficult to stably maintain electrophotographically uniform properties and water resistance with compatibility as compared with the case of using a photoconductive layer alone in the prior art. That is, the electrophotographic properties are affected by the under layer to result in the problems that the toner fogging and light-sensitive property are fluctuated by the environment and in particular, non-image areas of a print produce fishskined toner fogging under low temperature and low humidity conditions. As described above, the surface layer of an electrophotographic photoconductive material is subjected to formation of a toner image and the non-image areas are then rendered hydrophilic by an etching treatment to obtain a printing plate, but it is considerably difficult to allow the surface layer to maintain, with compatibility, both the electrophotographically uniform properties and the water resistance to such an extent that the printing plate does not stretch.

Furthermore, when it is tried to maintain electrophotographically uniform properties in the presence of an under layer, there arises a problem that a hard and brittle support must be used in view of the properties of materials used, resulting in breaking or cutting of a printing plate and springing thereof out of a printing drum. If a tough and flexible material is used for the under layer, electrophotographically uniform stability cannot be obtained, while fogging is increased during developing and fishskined toner fogging appear sometimes.

The present invention has been made to solve the above described problems caused by the provision of an under layer between a support and a photoconductive alyer and just below a photoconductive layer in the electrophotographic lithographic printing plate precursor.

SUMMARY OF THE INVENTION

It is an object of the present invention to provide an electrophotographic lithographic printing plate precursor excellent in printing adaptability as well as printing efficiency and capable of giving a high image quality print, whereby the above described problems of the prior art can be overcome.

It is another object of the present invention to provide an electrophotographic lithographic printing plate precursor capable of well maintaining both the electrophotographic properties and the printing properties with compatibility while preventing the plate stretching or cutting during printing.

These objects can be attained by an electrophotographic lithographic printing plate precursor comprising, at least, a photoconductive layer on one side of a support and an under layer just under the photoconductive layer, in which the under layer consists of a plurality of layers comprising an outermost layer having a surface resistivity of at most $1\times10^{11}$ Ω and an inner layer having a Cobb's water absorbing capacity of at most 15 g/m$^2$ (45 minute value) or a Young's modulus of at most 1000 kg/cm$^2$.

DETAILED DESCRIPTION OF THE INVENTION

The feature of the present invention consists in that the under layer provided between a support and a photoconductive layer and directly under the photoconductive layer to be contacted therewith is composed of a plurality of layers, whereby both the electrophotographic property (fog) and printing durability or strength maintenance are rendered compatible with each other, which has hitherto been difficult. That is, the under layer consists of an outermost layer (directly under a photoconductive layer and in contact with the photoconductive layer) having a surface resistivity of at most $1\times10^{11}$ Ω and an inner layer having a Cobb's water absorbing capacity of at most 15 g/m$^2$ (45 minute value) or a Young's modulus of at most 1000 kg/cm$^2$.

In the present invention, the outermost layer of the under layer has a surface resistivity of at most $1\times10^{11}$ Ω and therefore, the image-forming ability and developing ability, equal to the case of only a photoconductive layer, can be obtained without hindering the evenness of the electrophotographic properties of the photoconductive layer provided thereon.

Since the inner layer is a layer with a small water absorbing capacity, it is possible to improve the water resistance and to suppress the stretching of a printing plate, becoming a problem in the case of a single under layer, to such a level (0.1 to 0.2 ram) as offering no problem in real printing.

Since the inner layer having a Young's modulus of at most 1000 kg/cm$^2$ is provided, plate cutting is prevented.

In the present invention, a multi-layer structure sharing functions with one another is provided thereby to solve the problem of the prior art that when it is tried to lower the surface resistivity in a single layer, the flexibility of a support is lost and a printing plate cracks and leads to cutting during printing.

By Cobb's method is meant a method of examining the water absorbing capacity in the case of contacting one side of a non-absorbing paper or plate paper with water for a certain time according to JIS P-8140 "Test Method of Water Absorbing Capacity of Paper and Plate Paper". In the present invention, the contact time is 45 minutes. The water absorbing capacity according to this method is not directly related with the water repellent property of a paper.

In the present invention, moreover, a plural layer structure capable of alloting the functions to each as such is provided to solve such a problem arising in the case of a single layer that if the water resistance is rendered sufficient, the printing plate precursor or printing plate is too hard to smoothly conduct operations.

Now, the under layer of the present invention will be illustrated in detail. The outermost layer of the under layer in the present invention is a layer having a surface resistivity of at most $1\times10^{11}$ Ω. If the surface resistivity exceeds $1\times10^{11}$ Ω, fogging is increased. This is not preferable. In this respect, detailed experimental results will be given in the following Examples 1 and 2. The lower limit value is $1\times10^{7}$. At a lower surface resistivity than this value, leak takes place after charged at the periphery of the whole plate precursor and no image can be obtained even if imagewise exposed and developed.

In the present invention, in order to adjust the surface resistivity of the outermost layer in the above described range, it is preferable to incorporate at least one of electroconductive metal oxides such as titanium oxide, tin oxide, indium oxide, zinc oxide and the like; and colloidal alumina, colloidal silica, carbon blacks, surfactants such as polyoxyethylene alkyl ethers, fatty acids, fatty acid monoglycerides, alkylsulfonates, alkylmethylammonium salts, alkylphosphoric acid alkanolamine salts, polyoxyethylene alkylphosphates, etc. These materials can be added when a composition for the outermost layer is prepared and dispersed or a sample can be immersed in a dispersion of an electroconductive material after coating the outermost layer.

The outermost layer of the under layer in the present invention is composed of the above described electroconductive material and other materials for forming the outermost layer and as the other material, there can be used at least one member selected from the group consisting of various water-resisting materials, water-resisting organic solvent materials, synthetic emulsions and natural or synthetic hydrophilic high molecular materials.

Examples of the water-resisting material are water-resisting film-forming materials such as polyvinyl chloride, acrylic resins, polystyrene, alkyd resins, styrene-butadiene copolymers and ethylene-vinyl acetate copolymers and organic solvent-resisting film-forming materials such as starch, oxidized starch, PVA, methyl cellulose, hydroxyethyl cellulose and CMC.

As the water-resisting and organic solvent-resisting materials, for example, there are used ethylene-vinyl alcohol copolymers, high polymerization degree polyesters, high polymerization degree polyurethanes and the like. Furthermore, starch, PVA, acrylic resins (i.e. reactive acrylic resins in the form of organic solvent solutions or O/W type emulsions), alkyd resins (air-hardening type), etc. and crosslinking agents such as melamine resins can jointly be used as the water-resisting and organic solvent-resisting materials.

As the synthetic emulsion, there can be used those obtained by subjecting monomers or prepolymers such as acrylic acid esters, methacrylic acid esters, vinyl chloride, vinylidene chloride, vinyl acetate, polyurethanes prepolymers, acrylonitrile, butadiene, styrene-butadienes, etc. to emulsion polymerization or emulsion copolymerization.

Examples of the natural or synthetic hydrophilic high molecular materials include gelatins such as ordinary lime-treated gelatins, acid-treated gelatins, modified gelatins, derivative gelatins, etc., celluloses such as albumins, sodium alginate, gum arabic, latexes, cellulose, hydroxyethyl cellulose, carboxymethyl cellulose, etc., water-soluble derivatives such as starch, hydrophilic high molecular materials such as polyvinyl alcohol, polyvinylpyrrolidone, polyacrylamide, styrene-maleic anhydride copolymers and the like.

These materials for forming the outermost layer can of course be used in combination. If necessary, dispersants, levelling agents, crosslinking agents, etc. can be added to the outermost layer.

The proportion of the above described electroconductive material in the whole quantity of the outermost layer-forming composition, depending upon the materials used, is ordinarily about 0.1 to 10 weight % so that the surface resistivity may be in the range of at most $1\times10^{11}$ Ω.

The inner layer of the present invention can be composed of any material capable of satisfying the condition of an absorbing capacity of at most 15 g/m$^2$ (45 minute value) by the Cobb's method. The absorbing capacity value by the Cobb's method depends on not only the composition of a water-resisting coating agent of the inner layer, but also the thickness of the inner layer. In the case of a same composition, the water absorbing capacity is lowered with increase of the layer thickness. When the water absorbing capacity exceeds 15 g/m$^2$ (45 minute value), a printing plate meets with too excessive stretching to be put to practical use. In this respect, detailed experimental results are shown in the following Examples 1 and 2. The lower limit of the water absorbing capacity of the inner layer is not particularly limited.

The inner layer of the present invention can also be composed of any material capable of satisfying the condition of a Young's modulus of at most 1000 kg/cm$^2$. If Young's modulus exceeds 1000 kg/cm$^2$, the plate meets with deterioration of toughness and becomes brittle, so that as the support absorbs water and stretches during printing, cracking occurs in the inner layer, leading to breaking or cutting of the plate. In this respect, detailed experimental results are shown in the following Examples 3 and 4.

As the material for forming the inner layer, there can be used the various water-resisting materials, water-resisting and organic solvent-resisting materials and synthetic emulsions, described above as the material for forming the outermost layer, etc. and moreover, water-soluble high molecular compounds can be used. The proportion of the water-resisting material present in the whole quantity of the inner layer-forming composition is so adjusted that the Cobb's water absorbing capacity is in the range of the present invention, that is, it is ordinarily about 30 to 60 % by weight.

As the water-soluble high molecular compound, there are used starch or its water-soluble derivatives, water-soluble cellulose derivatives, casein, polyvinyl alcohol, styrene-maleic arthydride copolymers, vinyl acetate-maleic anhydride copolymers, etc. In this case, the quantity of this compound is so selected that the water absorbing capacity be at most 15 g/m$^2$ (45 minute value).

These materials for forming the inner layer can of course be used in combination. If necessary, dispersants, levelling agents, crosslinking agents, etc. can be added to the inner layer, as in the case of outermost layer.

In addition, the adhesiveness between both the outermost layer and inner layer can further be increased by adding a hydrophilic high molecular binder to one or both of the outermost layer and inner layer.

In the present invention, the thickness of the outermost layer is so adjusted that the function thereof can well be given and is not particularly limited, but it is generally in the range of 1 to 25 μm, preferably 1 to 15 μm. The thickness of the inner layer is generally 1 to 30 μm, preferably 3 to 20 μm and when the inner layer is composed of a plurality of layers, the total thickness should be in this range.

The whole thickness of the under layers including the outermost layer and inner layer of the present invention is generally 1 to 60 μm, preferably 4 to 40 μm.

As the support of the present invention, any of known support materials commonly used in the electrophotographic lithographic printing plate precursor of this kind can be used, for example, substrates such as metals, papers, plastic sheets, those subjected to a treatment for rendering electroconductive e.g., by impregnating a low resistance material therein, those provided with a water-resisting adhesive layer or at least one precoat layer, papers laminated with electroconductive foils such as Al foil, papers laminated with plastic sheets rendered electroconductive by vapor deposition of Al and the like.

The back side of a support (opposite surface to the surface provided with a photoconductive layer) can be provided with a back layer in known manner.

Examples of the electroconductive substrate or the material rendered electroconductive are described in Yukio Sakamoto, "Denshishashin (Electrophotography)" 14, No. 1, p 2–11 (1975), Hiroyuki Moriga, "Nyumon Tokushushi no Kagaku (Introduction to Chemistry of Special Papers)", published by Kobunshi Kankokai (1975), M. F. Hoover, "J. Macromol. Sci. Chem." A-4 (6), p 1327–1417, etc.

The photoconductive layer of the present invention contains at least a photoconductive material and binder. As the photoconductive material, any of inorganic materials and organic materials can be used.

Examples of the inorganic photoconductive material include Si, Ge, zinc oxide, cadmium sulfide, titanium oxide, selenium, cadmium selenide, zinc selenide or lead oxide, chalcogen alloys such as Se-Te alloys, $As_2S_3$, $As_2Se_3$, etc.

Examples of the organic photoconductive material include photoconductive cyanine pigments, photoconductive quinoline pigments, photoconductive phthalocyanine pigments, photoconductive pyridium salt pigments, substituted vinyloxazole, triphenylamine derivatives, anthracene, benzo condensed heterocyclic compounds, pyrazoline or imidazole derivatives, oxadiazole derivatives, vinylaromatic polymers and coplymerized products thereof, fluorenone derivatives, triarylalkanes such as triarylmethancleuco dyes and squaric acid derivative dyes, perylene, tetraeerie, carbazole, tetrabenzyl-p-phenylenediamine, squarium, indigo, dimethylperimide, polyvinyltetracene, polyvinylperylene, acylhydrazone derivatives, benzothiazole derivatives, tetracyanopyrene, chlorocyan blue and the like. These materials can be used in combination.

As the binder, there can be used silicone resins, polystyrene, polyacrylic acid or polymethacrylic acid esters, polyvinyl acetate, polyvinyl chloride, polyvinyl butyral and derivatives thereof or other known materials as a binder for a photoconductive layer.

The photoconductive material in the photoconductive layer is generally used in such a manner that the proportion or the photoconductive material to the binder is in the range of 3:1 to 20:1, but this is not particularly limited in the present invention. If necessary, a sensitizer or a coating aid commonly used for coating and other additives can be added.

The thickness of the photoconductive layer is generally about 2 to 20 μm, but this is not particularly limited in the present invention. In order to increase the bonding strength between the photoconductive layer and under layer, it is desirable to previously subject the surface of the under layer to a surface treatment such as corona discharge, glow discharge, flame, ultraviolet ray, ozone, plasma treatments and the like as described in U.S. Pat. No. 3,411, 908.

Preparation of the lithographic printing plate precursor can generally be carried out by a known technique in the field of producing the electrophotographic lithographic printing plate precursor of this kind, that is, by providing a support with at least one inner layer of the under layer, then providing an outermost layer, optionally providing a back layer and then providing an outermost layer, during which the support can previously be provided with a precoat layer or with a precoat layer and an intermediate layer. In any case, materials corresponding to a composition for forming the each layer are mixed, dispersed and coated and then dried and solidified by charging the coated one in an oven drier maintained at at least 100° C. for several minutes to form the object layer.

As a means for dispersing, there can be used ordinary ball mills, colloidal mills, ultrasonic dispersing machines, three roll mills, grain mills, homogenizers, homomixers, and the like. As a coating means, it is preferable to use air knife coaters, trailing grade coaters, wire bar coaters, reverse roll coaters, kiss roll coaters, fountain rosters and the like.

The precursor of the present invention, as illustrated above, is converted into a lithographic printing plate through the ordinary steps of charging, imagewise exposure, development, etc. The ordinary liquid development is of course suitable for the development of direct electron injection system, as described in Japanese Patent Application No. 89373/1988 and Japanese Patent Laid-Open Publication No. 132464/1990.

The present invention will now be illustrated in greater detail by way of examples, but it should be understood that the present invention is not limited thereto. In these examples, parts and percents are to be take as those by weight unless otherwise indicated.

Example 1

One surface of a fine quality paper with a basis weight of 100 g/m$^2$ was coated with a dispersion comprising a styrene-butadiene resin (referred to as "SBR") emulsion, starch, clay, melamine and water by the use of a wire bar and dried in an oven at 140° C. for 1 minute to form an inner layer with a coating amount of 7 g/m$^2$ as an under layer. At that time, the composition for the inner layer had the following component ratio, in which, however, the amount of the clay was varied so as to change the Cobb's water absorbing capacity of the inner layer side in five stages from about 2 g/m$^2$ (45 minute value) to about 50 g/m$^2$ (45 minute value), thus obtaining five samples (a), (b), (c), (d) and (e).

| Composition of Inner Layer | parts |
|---|---|
| SBR Emulsion | 30 |
| Starch | 3 |
| Clay | varied |
| Melamine | 3 |
| Water | 100 |

Then, a dispersion having a composition for an outermost layer comprising an SBR emulsion, electrically conductive titanium oxide, melamine and water was coated onto the inner layer by the use of a wire bar and dried in an oven at 140 ° C. for 1 minute to form an outer layer with a coating amount of 3 g/m$^2$. At that time, the composition for the outer layer had the following component ratio, in which, however, the amount of electrically conductive titanium oxide was varied so as to change the surface resistivity $\rho_s$ of the outer layer in four stages from about $1\times10^9\ \Omega$ to about $1\times10^{12}\ \Omega$, i.e. (1) $8.6\times10^8\ \Omega$, (2) $4.6\times10^{10}\ \Omega$, (3) $1.5\times10^{11}\ \Omega$ and (4) $9.5\times10^{11}\ \Omega$, thus obtaining four samples [(a)−(1) to (a)−(5), . . . (e)−(1) to (e)−(5)] every the above described samples (a) to (e), amounting to twenty samples.

| Composition of Outer Layer | parts |
|---|---|
| SBR Emulsion | 23 |

-continued

| Composition of Outer Layer | parts |
|---|---|
| Clay | 30 |
| Electroconductive Titanium Oxide | varied |
| Melamine | 2 |
| Water | 100 |

Then, a dispersion having a composition comprising 25 parts of an SBR emulsion, 45 parts of clay, 4 parts of casein, 4 parts of melamine and 100 parts of water was coated onto the back side of the paper, as a support of each of the above described twenty samples, by the use of a wire bar and dried in an oven at 140° C. for 1 minute to form a back layer with a coating amount of 10 g/m$^2$.

The Cobb's water absorbing capacity [g/m$^2$(45 minute value)] of the inner layer and the surface resistivity of the outermost layer of each of the thus resulting twenty samples were measured to obtain results as shown in Table 1:

TABLE 1

Properties of Samples (20 °C./65% RH)

| Surface Resistivity of Outer Layer | Cobb's Water Absorbing Capacity of Inner Layer [g/m$^2$ (45 minute value)] 2 | 11 | 16 | 28 | 47 |
|---|---|---|---|---|---|
| $8.6\times10^8\ \Omega$ | a-1 | b-1 | c-1 | d-1 | e-1 |
| $4.6\times10^{10}\ \Omega$ | a-2 | b-2 | c-2 | d-2 | e-2 |
| $1.5\times10^{11}\ \Omega$ | a-3 | b-3 | c-3 | d-3 | e-3 |
| $9.5\times10^{11}\ \Omega$ | a-4 | b-4 | c-4 | d-4 | e-4 |

A dispersion comprising 100 parts of photoconductive zinc oxide, 20 parts of acrylic resin, 125 parts of toluene, 0.1 part of phthalic anhydride and 4.5 parts of a 4% methanol solution of Rose Bengal was coated onto the outer layer side of the support of each of the thus resulting samples by the use of a wire bar and dried in an oven at 110° C. for 20 seconds to form a photoconductive layer with a coating amount of 25 g/m$^2$, thus obtaining an electrophotographic light-sensitive paper.

The electrophotographic light-sensitive paper was developed using a commercially available electrophotographic lithographic printing plate maker ELP 404 V (—commercial name—made by Fuji Photo Film Co.) and subjected to examination of fogging of an non-image area under ambient conditions of 20° C., 65% RH and 15° C., 30% RH to obtain results shown in Tables 2 and 3.

Each mark in Tables 2 and 3 means estimation of the fogging density as mentioned below:

| | Fogging Density |
|---|---|
| ○: | at most 0.6 |
| Δ: | 0.7–1.0 |
| : | 1.0–1.4 |
| X: | at least 1.5 |

When the fogging density is higher and exceeds 0. 7, more stain occurs so that the sample is not suitable for practical use.

TABLE 2

| Fogging of Non-image Area (20° C./65% RH) | | | | | |
|---|---|---|---|---|---|
| Surface Resistivity | Cobb's Water Absorbing Capacity [g/m² (45 minute value)] | | | | |
| (Ω) | a | b | c | d | e |
| 1 | ○ | ○ | ○ | ○ | ○ |
| 2 | ○ | ○ | ○ | ○ | ○ |
| 3 | Δ | Δ | ○ | Δ | ○ |
| 4 | X | ~X | ~X | | |

TABLE 3

| Fogging of Non-image Area (15° C./30% RH) | | | | | |
|---|---|---|---|---|---|
| Surface Resistivity | Cobb's Water Absorbing Capacity [g/m² (45 minute value)] | | | | |
| (Ω) | a | b | c | d | e |
| 1 | ○ | ○ | ○ | ○ | ○ |
| 2 | ○ | ○ | ○ | ○ | ○ |
| 3 | | | ○ | ○ | ○ |
| 4 | X | X | X | X | X |

It can be confirmed from the results of Tables 2 and 3 that even under severer ambient conditions of 15° C. and 30% RH, the surface resistivity of the under layer is adjusted to within the scope of the present invention to hold a region capable of sufficiently satisfying the electrophotographic property.

Then, the above described light-sensitive papers of (a−1~4) to (e−1~4) were subjected to an etching treatment using a commercially available hexacyanoferrate type etching solution ELP-E2 (—commercial name—made by Fuji Photo Film Co.) and stretching of the printing plate was examined after printing 800 prints as a printing plate. The results are shown in Table 4.

TABLE 4

| Plate Stretching After Printing 800 Prints | | | | | |
|---|---|---|---|---|---|
| Surface Resistivity | Cobb's Water Absorbing Capacity [g/m² (45 minute value)] | | | | |
| (Ω) | a | b | c | d | e |
| 1 | ○ | ○ | Δ | | X |
| 2 | ○ | ○ | Δ | | X |
| 3 | ○ | ○ | Δ | | X |
| 4 | ○ | ○ | Δ | | X |

Each mark in Table 4 estimation of the plate stretching was mentioned below:

| Plate Stretching | |
|---|---|
| ○: | at most 0.3 mm |
| Δ: | 0.4–0.6 mm |
| : | 0.7–1.0 mm |
| X: | at least 1.1 mm |

When the plate stretching exceeds 0.4 mm, there arises a problem that letters or images get out of position and the sample is not suitable for practical use.

The results of Tables 3 and 4 are combined to give Table 5, from which it is concluded that, of the twenty samples, Samples a−1, a−2, b−1 and b−2 exhibit less fogging and less plate stretching, that is, the object of the present invention can be achieved by specifying the surface resistivity of the outer layer in at most $1\times10^{11}\,\Omega$ and the Cobb's water absorbing capacity of the inner layer in at most 15 g/m² (45 minute value) according to the present invention.

TABLE 5

| Fogging (15° C., 30% RH)/Plate Stretching Property | | | | | |
|---|---|---|---|---|---|
| Surface Resistivity | Cobb's Water Absorbing Capacity [g/m² (45 minute value)] | | | | |
| (Ω) | a | b | c | d | e |
| 1 | ○/○ | ○/○ | ○/Δ | ○/ | ○/X |
| 2 | ○/○ | ○/○ | ○/Δ | ○/ | ○/X |
| 3 | /○ | /○ | Δ/Δ | Δ/ | Δ/X |
| 4 | X/○ | X/○ | X/Δ | X/ | X/X |

EXAMPLE 2

The procedure of Example 1 was repeated except using an acrylic emulsion instead of the SBR emulsion used in the inner layer and outer layer of the under layer in Example 1 and changing the quantity of the clay in such a manner that the Cobb's absorbing capacity of the inner layer be varied in four stages from about 2 g/m² (45 minute value) to about 50 g/m² (45 minute value).

| | parts |
|---|---|
| Composition of Inner Layer | |
| Acrylic Emulsion | 30 |
| Starch | 3 |
| Clay | varied |
| Melamine | 3 |
| Water | 100 |
| Composition of Outer Layer | |
| Acrylic Emulsion | 23 |
| Clay | 30 |
| Electroconductive Titanium Oxide | varied |
| Melamine | 2 |
| Water | 100 |

The Cobb's water absorbing capacity [g/m² (45 minute value)] of the inner layer and the surface resistivity of the outermost layer of each of the thus resulting sixteen samples were measured to obtain results as shown in Table 6:

TABLE 6

| Properties of Samples (20° C./65% RH) | | | | |
|---|---|---|---|---|
| Surface Resistivity | Cobb's Water Absorbing Capacity of Inner Layer [g/m² (45 minute value)] | | | |
| of Outer Layer | 7 | 13 | 33 | 41 |
| $1.1\times10^{9}\,\Omega$ | f-5 | g-5 | h-5 | i-5 |
| $2.3\times10^{10}\,\Omega$ | f-6 | g-6 | h-6 | i-6 |
| $6.1\times10^{11}\,\Omega$ | f-7 | g-7 | h-7 | i-7 |
| $8.4\times10^{12}\,\Omega$ | f-8 | g-8 | h-8 | i-8 |

When these sixteen samples were subjected to a development (estimation of fogging) and printing test in an analogous manner to Example 1, results shown in Table 7 were obtained. Each mark of Table 7 has the same meaning as in Tables 2 to 5.

TABLE 7

| Fogging (15° C., 30% RH)/Plate Stretching Property | | | | |
|---|---|---|---|---|
| Surface Resistivity | Cobb's Water Absorbing Capacity [g/m² (45 minute value)] | | | |
| (Ω) | f | g | h | i |
| 5 | ○/○ | ○/○ | ○/X | ○/X |
| 6 | ○/○ | ○/○ | ○/X | ○/X |
| 7 | /○ | /○ | Δ/X | Δ/X |
| 8 | X/○ | X/○ | X/X | X/X |

It is thus concluded from the results of Table 7 that, of the sixteen samples, Samples f−5, f−6, g−5 and g−6 exhibit less fogging and less plate stretching, that is, the object of the present invention can be achieved by specifying the surface resistivity of the outer layer in at most $1\times10^{11}$ Ω and the Cobb's water absorbing capacity of the inner layer in at most 15 g/m$^2$ (45 minute value) according to the present invention.

Comparative Example 1

One surface of a fine quality paper with a basis weight of 100 g/m$^2$ was coated with a dispersion comprising an SBR emulsion, starch, clay, melamine and water by the use of a wire bar and dried in an oven at 140° C. for 1 minute to form an undercoated layer with a coating amount of 15 g/m$^2$. At that time, the composition for the undercoated layer had the following component ratio, in which, however, the amount of the clay was varied so as to change the Cobb's water absorbing capacity of the inner layer side in five stages from about 2 g/m$^2$ (45 minute value) to about 50 g/m$^2$ (45 minute value). Ordinarily, the coating amount of the undercoated layer is about 5 to 15 g/m$^2$, since if the coating amount is less than 5 g/m$^2$, the water resistance is decreased, while if more than 15 g/m$^2$, the paper is stiffened to degrade the developing adaptability and printing property. Thus, the coating amount was adjusted 15 g/m 2, as the upper limit, so as to prevent the paper from stiffening while suppressing the Cobb's water absorbing capacity to the desired region. However, it was impossible to adjust the Cobb's water absorbing capacity to at most 15 g/m$^2$ (45 minute value) while maintaining the surface resistivity in about $1\times10^9$ Ω.

| Composition of Undercoated Layer | parts |
|---|---|
| SBR Emulsion | 30 |
| Starch | 3 |
| Clay | varied |
| Electrically Conductive Titanium Oxide | varied |
| Melamine | 3 |
| Water | 100 |

Then, a dispersion having a composition comprising 25 parts of an SBR emulsion, 45 parts of clay, 4 parts of casein, 4 parts of melamine and 100 parts of water was coated onto the back surface of the paper, as a support of each of these samples, by the use of a wire bar and dried in an oven at 140° C. for 1 minute to form a back layer with a coating amount of 10 g/m$^2$.

Then, a dispersion having a composition comprising 100 parts of photoconductive zinc oxide, 20 parts of acrylic resin, 125 parts of toluene, 0.1 part of phthalic anhydride and 4.5 parts of a 4% methanol solution of Rose Bengal was coated onto the undercoated layer by the use of a wire bar and dried in an oven at 110° C. for 20 seconds to form a photoconductive layer with a coating amount of 25 g/m$^2$, thus obtaining a electrophotographic light-sensitive paper.

When the thus resulting electrophotographic light-sensitive paper was subjected to a printing test in an analogous manner to Example 1, no sample showing a plate stretching of 0.3 mm or less after printing 800 prints was found.

Comparative Example 2

One surface of a fine quality paper with a basis weight of 100 g/m$^2$ was coated with a dispersion comprising an SBR emulsion, starch, clay, electrically conductive titaniumm oxide, melamine and water by the use of a wire bar and dried in an oven at 140° C. for 1 minute to form an undercoated layer with a coating amount of 15 g/m$^2$. At that time, the composition for the undercoated layer had the following component ratio, in which, however, the amount of the clay was varied so as to keep the Cobb's water absorbing capacity of the undercoated layer constant, i.e. about 5 g/m$^2$ (45 minute value) and the amount of the electrically conductive titanium oxide was varied so as to change the surface resistivity of the undercoated layer about about $1\times10^9$ Ω. However, it was impossible to adjust the surface resistivity to at most $1\times10^{11}$ Ω, while maintaining the coating amount of 15 g/m$^2$.

| Composition of Undercoated Layer | parts |
|---|---|
| SBR Emulsion | 30 |
| Starch | 3 |
| Clay | varied |
| Electrically Conductive Titanium Oxide | varied |
| Melamine | 3 |
| Water | 100 |

Then, a dispersion having a composition comprising 25 parts of an SBR emulsion, 45 parts of clay, 4 parts of casein, 4 parts of melamine and 100 parts of water was coated onto the back surface of the paper, as a support of each of these samples, by the use of a wire bar and dried in an oven at 140° C. for 1 minute to form a back layer with a coating amount of 10 g/m$^2$.

Further, a dispersion having a composition comprising 100 parts of photoconductive zinc oxide, 20 parts of acrylic resin, 125 parts of toluene, 0.1 part of phthalic anhydride and 4.5 parts of a 4% methanol solution of Rose Bengal was coated onto the undercoated layer by the use of a wire bar and dried in an oven at 110° C. for 20 seconds to form a photoconductive layer with a coating amount of 25 g/m$^2$, thus obtaining a electrophotographic light-sensitive paper.

When the thus resulting electrophotographic light-sensitive paper was subjected to a test of fogging after development in an analogous manner to Example 1, no sample showing a fogging density of 0.6 or less under ambient conditions of 15° C./30% RH.

EXAMPLE 3

One surface of a fine quality paper with a basis weight of 100 g/m$^2$ was coated with a dispersion comprising an SBR emulsion, poval (polyvinyl alcohol), clay, starch, melamine and water by the use of a wire bar and dried in an oven at 140 ° C. for 1 minute to form an inner layer with a coating amount of 7 g/m$^2$ as an under layer. At that time, the composition for the inner layer had the following component ratio, in which, however, the amounts of the SBR emulsion and poval were varied so as to change the Young's modulus as a single film in four stages from about 300 kg/cm$^2$ to about 3000 kg/cm$^2$, thus obtaining four samples (j), (k), (l) and (m).

| Composition of Inner Layer | parts |
|---|---|
| SBR Emulsion | varied |
| Poval | varied |
| Starch | 3 |

-continued

| Composition of Inner Layer | parts |
|---|---|
| Clay | 30 |
| Melamine | 3 |
| Water | 100 |

Herein, the single film of the inner layer composition was obtained by coating a glass support with the dispersion of the composition by means of a wire bar, naturally drying, drying in an oven at 140 ° C. for 1 minute to form a film with a coating amount of 100 g/m$^2$ and stripping the resulting film from the glass support.

Then, a dispersion having a composition for an outermost layer comprising an SBR emulsion, electrically conductive titanium oxide, melamine and water was coated onto the inner layer by the use of a wire bar and dried in an oven at 140 ° C. for 1 minute to form an outer layer with a coating amount of 3 g/m$^2$. At that time, the composition for the outer layer had the following component ratio, in which, however, the amount of electrically conductive titanium oxide was varied so as to change the surface resistivity $\rho_s$ of the outer layer in four stages from about $1\times10^9\ \Omega$ to about $1\times10^{12}\ \Omega$, and was coated onto each of the above described samples (j) to (m), thus obtaining four samples every above described samples (j) to (m), amounting to sixteen samples.

| Composition of Outer Layer | parts |
|---|---|
| SBR Emulsion | 23 |
| Clay | 30 |
| Electroconductive Titanium Oxide | varied |
| Melamine | 2 |
| Water | 100 |

Then, a dispersion having a composition comprising 25 parts of an SBR emulsion, 45 parts of clay, 4 parts of casein, 4 parts of melamine and 100 parts of water was coated onto the back side of the paper, as a support of each of the above described sixteen samples, by the use of a wire bar and dried in an oven at 140° C. for 1 minute to form a back layer with a coating amount of 10 g/m$^2$.

The Young's modulus of the single film of the inner layer composition and the surface resistivity of the outermost layer of each of the thus resulting sixteen samples were measured to obtain results as shown in Table 8:

TABLE 8

| Properties of Samples (20° C./65% RH) | | | | |
|---|---|---|---|---|
| Surface Resistivity of Outer Layer | Young's Modulus of Inner Layer (kg/cm$^2$) | | | |
| | 2230 | 1300 | 970 | 280 |
| $1.2\times10^7\ \Omega$ | j-1 | k-1 | l-1 | m-1 |
| $5.5\times10^9\ \Omega$ | j-2 | k-2 | l-2 | m-2 |
| $2.6\times10^{11}\ \Omega$ | j-3 | k-3 | l-3 | m-3 |
| $4.1\times10^{12}\ \Omega$ | j-4 | k-4 | l-4 | m-4 |

A dispersion comprising 100 parts of photoconductive zinc oxide, 20 parts of acrylic resin, 125 parts of toluene, 0.1 part of phthalic anhydride and 4.5 parts of a 4% methanol solution of Rose Bengal was coated onto the outer layer side of the support of each of the thus resulting samples by the use of a wire bar and dried in an oven at 110° C. for 20 seconds to form a photoconductive layer with a coating amount of 25 g/m$^2$, thus obtaining an electrophotographic light-sensitive paper.

The electrophotographic light-sensitive paper was developed using a commercially available electrophotographic lithographic printing plate maker ELP 404 V (—commercial name—made by Fuji Photo Film Co.) and subjected to examination of fogging of an non-image area under ambient conditions of 20° C., 65% RH and 15° C., 30% RH to obtain results shown in Tables 9 and 10.

Each mark in Tables 9 and 10 means estimation of the fogging density as mentioned below:

| | Fogging Density |
|---|---|
| ○: | at most 0.6 |
| Δ: | 0.7–1.0 |
| : | 1.0–1.4 |
| X: | at least 1.5 |

When the fogging density is higher and exceeds 0.7, more stain occurs so that the sample is not suitable for practical use.

TABLE 9

| Fogging of Non-image Area (20° C./65% RH) | | | | |
|---|---|---|---|---|
| Surface Resistivity (Ω) | Young's Modulus (kg/cm$^2$) | | | |
| | j | k | l | m |
| 1 | ○ | ○ | ○ | ○ |
| 2 | ○ | ○ | ○ | ○ |
| 3 | ○ | ○ | ○ | ○ |
| 4 | X | X | X | X |

TABLE 10

| Fogging of Non-image Area (15° C./30% RH) | | | | |
|---|---|---|---|---|
| Surface Resistivity (Ω) | Young's Modulus (kg/cm$^2$) | | | |
| | j | k | l | m |
| 1 | ○ | ○ | ○ | ○ |
| 2 | ○ | ○ | ○ | ○ |
| 3 | ○ | ○ | Δ | |
| 4 | X | X | X | X |

It can be confirmed from the results of Tables 9 and 10 that even under severer ambient conditions of 15 ° C. and 30% RH, the surface resistivity of the under layer is adjusted to within the scope of the present invention to hold a region capable of sufficiently satisfying the electrophotographic property.

Then, the above described light-sensitive papers of (j−1∼4) to (m−1∼4) were subjected to an etching treatment using a commercially available hexacyanoferrate type etching solution ELP-E2 (—commercial name—made by Fuji Photo Film Co.) and cutting of the printing plate was examined, as a property of printing plate, after printing 200 prints as a printing plate, using a printing machine of AD-80 type (—commercial name—, made by Ryobi Insatsuki KK). The results are shown in Table 11.

TABLE 11

| Plate Cutting After Printing 200 Prints | | | | |
|---|---|---|---|---|
| Surface Resistivity (Ω) | Young's Modulus [kg/cm$^2$] | | | |
| | j | k | l | m |
| 1 | X | Δ | ○ | ○ |
| 2 | X | | ○ | ○ |

TABLE 11-continued

| Plate Cutting After Printing 200 Prints | | | | |
|---|---|---|---|---|
| Surface Resistivity (Ω) | Young's Modulus [kg/cm²] j | k | l | m |
| 3 | X | | ○ | ○ |
| 4 | X | Δ | ○ | ○ |

Each mark in Table 11 estimation of the plate stretching was mentioned below:

○: no plate cutting, no breaking

: plate cutting, breaking amounting to at least ⅓ of whole

○: plate cutting, breaking amounting to at least /2 of whole

X: plate cutting, completely broken

In the case of "plate cutting", the sample is not suitable for practical rise.

The results of Tables 10 and 11 are combined to give Table 12, from which it is concluded that, of the sixteen samples, Samples l−1, l−2, m−1 and m−2 exhibit less fogging and less plate cutting, that is, the object of the present invention can be achieved by specifying the surface resistivity of the outer layer in at most $1\times10^{11}$ Ω and the Young's Modulus of the inner layer in at most 1000 kg/cm² according to the presentinvention.

TABLE 12

| Fogging (15° C., 30% RH)/Plate Cutting Property | | | | |
|---|---|---|---|---|
| Surface Resistivity (Ω) | Young's Modulus of Inner Layer (kg/cm²) j | k | l | m |
| 1 | ○/X | ○/Δ | ○/○ | ○/○ |
| 2 | ○/X | ○/ | ○/○ | ○/○ |
| 3 | ○/X | ○/ | Δ/○ | /○ |
| 4 | X/X | X/Δ | X/○ | X/○ |

EXAMPLE 4

The procedure of Example 3 was repeated except using an acrylic emulsion instead of the SBR emulsion used in the inner layer and outer layer of the under layer in Example 3 and changing the quantity of the poval in such a manner that the Young's Modulus of the inner layer be varied in three stages from about 400 kg/cm² to about 2000 kg/cm²

| | parts |
|---|---|
| Composition of Inner Layer | |
| Acrylic Emulsion | 30 |
| Poval | varied |
| Starch | 3 |
| Clay | 30 |
| Melamine | 3 |
| Water | 100 |
| Composition of Outer Layer | |
| Acrylic Emulsion | 23 |
| Clay | 30 |
| Electroconductive Titanium Oxide | varied |
| Melamine | 2 |
| Water | 100 |

The Young's modulus of the single film of the inner layer composition and the surface resistivity of the outermost layer of each of the thus resulting twelve samples were measured to obtain results as shown in Table 13:

TABLE 13

| Properties of Samples (20° C./65% RH) | | | |
|---|---|---|---|
| Surface Resistivity of Outer Layer | Young's Modulus of Inner (kg/cm²) 1800 | 960 | 410 |
| $8.9\times10^{9}$ Ω | n-5 | o-5 | p-5 |
| $5.8\times10^{10}$ Ω | n-6 | o-6 | p-6 |
| $4.3\times10^{11}$ Ω | n-7 | o-7 | p-7 |
| $9.8\times10^{11}$ Ω | n-8 | o-8 | p-8 |

When these twelve samples were subjected to a development (estimation of fogging) and printing test in an analogous manner to Example 3, results shown in Table 14 were obtained. Each mark of Table 14 has the same meaning as in Tables 9 to 12.

TABLE 14

| Fogging (15° C., 30% RH)/Plate cutting Property | | | |
|---|---|---|---|
| Surface Resistivity (Ω) | Young's Modulus of Inner Layer [kg/cm²] n | o | p |
| 5 | ○/X | ○/○ | ○/○ |
| 6 | ○/X | ○/○ | ○/○ |
| 7 | /X | X/○ | X/○ |
| 8 | X/X | X/○ | X/○ |

It is thus concluded from the results of Table 14 that, of the twelve samples, Samples o−5, o−6, p−5 and p−6 exhibit less fogging and less plate cutting, that is, the object of the present invention can be achieved by specifying the surface resistivity of the outer layer in at most $1\times10^{11}$ Ω and the Young's Modulus of the inner layer in at most 1000 kg/cm² according to the present invention.

Comparative Example 3

One surface of a fine quality paper with a basis weight of 100 g/m² was coated with a dispersion comprising an SBR emulsion, poval, starch, clay, melamine and water by the use of a wire bar and dried in an oven at 140° C. for 1 minute to form an undercoated layer with a coating amount of 15 g/m². At that time, the composition for the undercoated layer had the following component ratio, in which, however, the amount of the clay was varied so as to keep constant the surface resistivity of the undercoated layer at a surface resistivity $\rho_s$ of $1\times10^{9}$ and the amounts of the SBR emulsion and poval were varied to change the Young's Modulus of a single film of the composition in the range of from about 300 kg/cm² to about 3000 kg/cm². However, it was impossible to adjust the Young's Modulus to at most 1000 kg/cm² while maintaining the surface resistivity at $1\times10^{9}$.

| Composition of Undercoated Layer | |
|---|---|
| | parts |
| SBR Emulsion | 30 |
| Poval | varied |
| Starch | 3 |
| Clay | 30 |
| Melamine | 3 |
| Water | 100 |

Then, a dispersion having a composition comprising 25 parts of an SBR emulsion, 45 parts of clay, 4 parts of casein, 4 parts of melamine and 100 parts of water was coated onto the back surface of the paper, as a support of each of these samples, by the use of a wire bar and dried in an oven at 140° C. for 1 minute to form a back layer with a coating amount of 10 g/m$^2$.

Then, a dispersion having a composition comprising 100 parts of photoconductive zinc oxide, 20 parts of acrylic resin, 125 parts of toluene, 0.1 part of phthalic anhydride and 4.5 parts of a 4% methanol solution of Rose Bengal was coated onto the undercoated layer by the use of a wire bar and dried in an oven at 110° C. for 20 seconds to form a photoconductive layer with a coating amount of 25 g/m$^2$, thus obtaining a electrophotographic light-sensitive paper.

When the thus resulting electrophotographic light-sensitive paper was subjected to a printing test in an analogous manner to Example 3, no sample showing no plate cutting was found after printing 800 prints.

Advantages of the Invention

As illustrated above, according to the present invention, there can be provided an electrophotographic lithographic printing plate precursor capable of well maintaining both the electrophotographic properties and the printing properties by composing an under layer of a plurality of layers, an outermost layer having a surface resistivity of at most $1\times10^{11}$ Ω to maintain the electrophotographic properties, in particular, developing property and an inner layer having a Cobb's water absorbing capacity of at most 15 g/m$^2$ (45 minute value) to prevent plate stretching during printing or having a Young's Modulus of at most 1000 kg/cm$^2$ to prevent plate cutting during printing.

What is claimed is:

1. An electrophotographic lithographic printing plate precursor comprising, at least, a photoconductive layer on one side of a support and an under layer directly under the photoconductive layer, in which the under layer consists of a plurality of layers comprising an outermost layer having a surface resistivity of at most $1\times10^{11}$ Ω and an inner layer having a Cobb's water absorbing capacity of at most 15 g/m$^2$ (45 minute value).

2. An electrophotographic lithographic printing plate precursor comprising, at least, a photoconductive layer on one side of a support and an under layer directly under the photoconductive layer, in which the under layer consists of a plurality of layers comprising an outermost layer having a surface resistivity of at most $1\times10^{11}$ Ω and an inner layer having a Young's Modulus of at most 1000 kg/cm$^2$.

3. The electrophotographic lithographic printing plate precursor as claimed in claim 1 or 2, wherein the outermost layer consists of an outermost layer-forming material and an electrically conductive material.

4. The electrophotographic lithographic printing plate precursor as claimed in claim 3, wherein the outermost layer-forming material is at least one member selected from the group consisting of water-resisting film-forming materials, organic solvent-resisting film-forming materials, water-resisting and organic solvent-resisting materials, synthetic emulsions and natural or synthetic hydrophilic high molecular materials.

5. The electrophotographic lithographic printing plate precursor as claimed in claim 4, wherein the water-resisting film-forming materials are polyvinyl chlorides, acrylic resins, polystyrenes, polyethylenes, alkyd resins, styrene-butadiene copolymers and ethylene-vinyl acetate copolymers.

6. The electrophotographic lithographic printing plate precursor as claimed in claim 4, wherein the organic solvent-resisting film-forming materials are starch, oxidized starch, PVA, methyl cellulose, hydroxyethyl cellulose and CMC.

7. The electrophotographic lithographic printing plate precursor as claimed in claim 4, wherein the water-resisting and organic solvent-resisting materials are ethylene-vinyl alcohol copolymers, high polymerization degree polyesters and high polymerization degree polyurethanes.

8. The electrophotographic lithographic printing plate precursor as claimed in claim 4, wherein the synthetic emulsions are those obtained by subjecting at least one monomer or propolymer selected from the group consisting of acrylic acid esters, mothacrylic acid esters, vinyl chloride, vinylidene chloride, vinyl acetate, polyurethane prepolymers, acrylonitrile, butadiene and styrene-butadienes to emulsion polymerization or emulsion copolymerization.

9. The electrophotographic lithographic printing plate precursor as claimed in claim 4, wherein the natural or synthetic hydrophilic high molecular materials are ordinary lime-treated gelatins, acid-treated gelatins, modified gelatins, derivative gelatins, albumins, sodium alginate, gum arabic, latexes, cellulose, hydroxyethyl cellulose, carboxymethyl cellulose, water-soluble starch, polyvinyl alcohol, polyvinylpyrrolidone, polyacrylamide and styrene-maleic anhydride copolymers.

10. The electrophotographic lithographic printing plate precursor as claimed in claim 3, wherein the electrically conductive material is present in a proportion of about 0.1 to 10% by weight.

11. The electrophotographic lithographic printing plate precursor as claimed in claim 1 or 2, wherein the outermost layer further contains at least one member selected from the group consisting of dispersants, levelling agents and crosslinking agents.

12. The electrophotographic lithographic printing plate precursor as claimed in claim 1 or 2, wherein the inner layer consists of at least one member selected from the group consisting of water-resisting film-forming materials, organic solvent-resisting film-forming materials, water-resisting and organic solvent-resisting materials, synthetic emulsions and natural or synthetic hydrophilic high molecular materials.

13. The electrophotographic lithographic printing plate precursor as claimed in claim 12, wherein the inner layer contains a water-resisting material in a proportion of 30 to 60% by weight.

14. The electrophotographic lithographic printing plate precursor as claimed in claim 4, wherein the natural or synthetic hydrophilic high molecular materials are starch or its water-soluble derivatives, water-soluble cellulose derivatives, casein, polyvinyl alcohol, styrene-maleic anhydride copolymers and vinyl acetate-maleic anhydride copolymers.

15. The electrophotographic lithographic printing plate precursor as claimed in claim 1 or 2, wherein the outermost layer has a thickness of 1 to 25 μm and the inner layer has a thickness of 1 to 30 μm, the total thickness of the outermost layer and inner layer amounting to 1 to 60 μm.

* * * * *